US006502071B1

(12) United States Patent
Nagasaki

(10) Patent No.: US 6,502,071 B1
(45) Date of Patent: Dec. 31, 2002

(54) COMFORT NOISE GENERATION IN A RADIO RECEIVER, USING STORED, PREVIOUSLY-DECODED NOISE AFTER DEACTIVATING DECODER DURING NO-SPEECH PERIODS

(75) Inventor: Mayumi Nagasaki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/354,272

(22) Filed: Jul. 15, 1999

(51) Int. Cl.[7] ..... G10L 11/02
(52) U.S. Cl. ..... 704/226; 704/228; 704/233
(58) Field of Search ..... 704/226, 228, 704/233

(56) References Cited

U.S. PATENT DOCUMENTS

| | | | | | |
|---|---|---|---|---|---|
| 5,487,087 | A | * | 1/1996 | McCree et al. | 375/245 |
| 5,568,514 | A | * | 10/1996 | McCree et al. | 375/245 |
| 5,694,426 | A | * | 12/1997 | McCree et al. | 375/243 |
| 5,835,851 | A | * | 11/1998 | Rasmusson et al. | 455/79 |
| 5,940,380 | A | * | 8/1999 | Poon et al. | 370/330 |
| 5,949,888 | A | * | 9/1999 | Gupta et al. | 381/66 |
| 5,974,374 | A | * | 10/1999 | Wake | 704/215 |
| 6,240,383 | B1 | * | 5/2001 | Tanaka | 704/219 |

FOREIGN PATENT DOCUMENTS

| | | |
|---|---|---|
| JP | 6-125273 | 5/1994 |
| JP | 7-129195 | 5/1995 |
| JP | 7-273738 | 10/1995 |
| JP | 2541484 | 7/1996 |
| JP | 9-97098 | 4/1997 |
| JP | 9-149104 | 6/1997 |
| JP | 9-261184 | 10/1997 |
| JP | 3055608 | 4/2000 |

* cited by examiner

*Primary Examiner*—Tālivaldis Ivars Šmits
(74) *Attorney, Agent, or Firm*—Whitham, Curtis & Christofferson, P.C.

(57) ABSTRACT

Power conservation, when generating background noise samples in a radio receiver, is disclosed. Background noise data is generated using at least one noise parameter that is transmitted in a manner included in framed noise information. This information is transmitted at predetermined time intervals during a period of no-speech. A controller is provided so as to check to determine if an incoming framed data is the noise information. In the case where the incoming framed data is specified as the noise information, a check is made to determine if a time period, which corresponds to a predetermined number of consecutive frames, has expired. When the time period has not yet elapsed, the background noise data is generated using at least one noise parameter in a manner of extending to the predetermined number of frames. The background noise data thus generated is decoded at a decoder on a frame-by-frame basis so as generate background noise samples, and then these decoded noise samples are applied to a digital-to-analog converter and simultaneously stored in a memory. After the background noise sample generation is finished, the decoder is de-energized. The background noise samples already stored in the memory are successively retrieved and are converted into audible signal.

14 Claims, 5 Drawing Sheets

COMFORT NOISE GENERATION IN A RADIO RECEIVER, USING STORED, PREVIOUSLY-DECODED NOISE AFTER DEACTIVATING DECODER DURING NO-SPEECH PERIODS

BACKGROUND OF THE INVENTION

1. Field of the Invention

The present invention relates generally to techniques for reducing power consumption of a mobile unit during periods of no-speech in a digital mobile telephone system. More specifically, the present invention relates to a method and apparatus for periodically energizing and de-energizing a decoder for generating background noise samples for power conservation, during periods of no-speech.

2. Description of the Related Art

It is known in the art that many efforts have been made to reduce power consumption of mobile units in a digital mobile telephone system. One such power conservation technique is to terminate radiation of data in the absence of a speech signal to be transmitted. That is, during periods of no-speech, the transmitter ceases signal radiation except for periodic transmission of background noise information. However, no proposal has been made for intermittently terminating the operation of a decoder, which is provided in a receiver, during the periods of no-speech.

Prior to turning to the present invention, it is advantageous to briefly describe a conventional technique for generating background noise samples using periodically transmitted background noise information. That is, this conventional technique is to fill in the no-speech periods using the noise information intermittently transmitted to the receiver. The signal processing in the digital telephone system is typically implemented on a frame-by-frame basis at both the transmitter and receiver. It is assumed, for a better understanding of the present invention, that each frame length is 10 ms and the frame of background noise information is transmitted at a time interval of one minute.

Referring to FIG. 1, a series of framed background noise information is periodically transmitted from a transmitter (not shown) during time periods of no-speech.

The transmitted framed sound signal (speech and no-speech) is received at an antenna 10 and is fed to a receiving section (RX) 12 wherein the transmitted signal is translated to an intermediate frequency (IF). Further, the receiving section 12 demodulates the incoming signal and outputs a baseband signal. This baseband signal is a compressed signal and thus it is necessary to be decompressed (expanded) before being applied to a digital-to-analog (D-A) converter whose output drives a speaker.

The compressed baseband signal takes the form of a series of frames each including 100 bits (for example). One bit of each frame is dedicated to an indicator, which specifies whether the frame is a speech signal or a no-speech signal. The speech/no-speech indicator bit is typically a leading bit of each frame. The output of the receiving section 12 is applied, on a frame-by-frame basis, 1 to a bit signal separator 14 which separates the one-bit of speech/no-speech indicator and the remaining bits (viz., 99 bits according to the above-mentioned assumption). The data bits are applied to a buffer 16, while the speech/no-speech indicator bit is applied to a buffer 18. Assuming that the speech/no-speech indicator bit takes a logic "1" for indicating that the corresponding frame is a speech frame while taking a logic "0" for indicating that the corresponding frame is an unvoiced frame.

A background noise data generation controller 20 responds to the output of the buffer 18 and controls a switch 22 as follows. That is, when the output of the buffer 18 is a logic "1", the controller 20 controls the switch 22 so as to relay the speech signal (frame) to a decoder 26 via a terminal 22*a*. Thus, the decoder 26 decompresses (expands) the applied speech signal (digital) and applies the decompressed signal to a digital-to-analog (D-A) converter 28. The analog audio signal thus generated is applied, via a speaker driver 30, to a loudspeaker 32 at which an original sound is reproduced.

On the other hand, when the output of the buffer 18 takes a logic "0", the controller 20 controls the switch 22 so as to relay one frame of background noise information to a memory 24 via a terminal 22*b*. Although it is not evident from FIG. 1, the background noise information (one frame) bypasses the memory 24 and at the same time is stored in the memory 24. Thereafter, until the next background noise information is received, the noise information stored in the memory 24 is read out memory on a frame-by-frame basis and is decompressed at the decoder 26. The decompressed noise signal is applied to the D-A converter as in the case of the speech signal.

It is understood that the decoder 26 continues to be energized irrespective of whether the incoming frame is the speech or no-speech signal.

Japanese Laid-open Patent Application No. 5-122165 discloses a background noise sample generating technique similar to the above. This Japanese Application teaches an intermittent transmission of background noise or parameters during the periods of no-speech. Further, the above-mentioned Japanese Patent Application discloses that the background noise information contains a noise parameter which is used to synthesize background noise data in order to reduce discomfort to a listener. However, the aforesaid Japanese Patent Application fails to teach or suggest intermittent de-energizing of a decoder for power conservation.

SUMMARY OF THE INVENTION

It is therefore an object of the present to provide techniques via which a decoder is intermittently de-energized during periods of no-speech thereby to implement power conservation of a mobile unit.

In brief, this object is achieved by techniques wherein the background noise data is generated using at least one noise parameter that is transmitted in a manner included in framed noise information. This information is transmitted at predetermined time intervals during a period of no-speech. A controller is provided so as to check to determine if an incoming framed data is the noise information. In the case where the incoming framed data is specified as the noise information, a check is made to determine if a time period, which corresponds to a predetermined number of consecutive frames, has expired. When the time period has not yet elapsed, the background noise data is generated using at least one noise parameter in a manner of extending to the predetermined number of frames. The background noise data thus generated is decoded at a decoder on a frame-by-frame basis so as to generate decoded background noise samples, and then these noise samples are applied to a digital-to-analog converter and simultaneously stored in a memory. After the background noise sample generation is finished, the decoder is de-energized. The decoded background noise samples already stored in the memory are successively retrieved and are converted into audible signal.

One aspect of the pre sent invention resides in a method of generating background noise samples in a radio receiver.

The method comprises the following steps. A check is made to determine if an incoming framed data is noise information, after which a further check is made to determine if a time period corresponding to a predetermined number of frames has expired if the incoming framed data is specified as the noise information. The background noise data is generated, using the at least one noise parameter included in the incoming framed data, in a manner that the noise data extends to the predetermined number of frames if the time period has not expired. Then, a decoder is energized to successively decode the background noise data so as to generate decoded background noise samples that are then stored in a memory. The decoded background noise sample thus stored in the memory are read out thereof during a period of no-speech. The background noise samples are renewed using each of the following noise information intermittently transmitted.

Another aspect of the present invention resides in an apparatus for generating background noise samples at a radio receiver. The apparatus comprises, a controller for controlling generation of background noise data, the controller checking to determine if an incoming framed data is noise information. A background noise data generator is provided which, in response to a check result of the incoming framed data being the noise information, generates the background noise data using said at least one noise parameter included in the incoming framed data. The background noise data extends to a predetermined number of frames. A decoder decodes the background noise data, which has been generated by said background noise data generator, so as to generate background noise samples. A memory is provided for storing the decoded background noise samples. The decoded noise samples stored in the memory is retrieved during a period of no-speech while de-energizing the decoder.

BRIEF DESCRIPTION OF THE DRAWINGS

The features and advantages of the present invention will become more clearly appreciated from the following description taken in conjunction with the accompanying drawings in which like elements are denoted by like reference numerals and in which.

DETAILED DESCRIPTION OF THE PREFERRED EMBODIMENTS

A preferred embodiment of the present invention will be described with reference to FIGS. 2–5.

Figure 1:
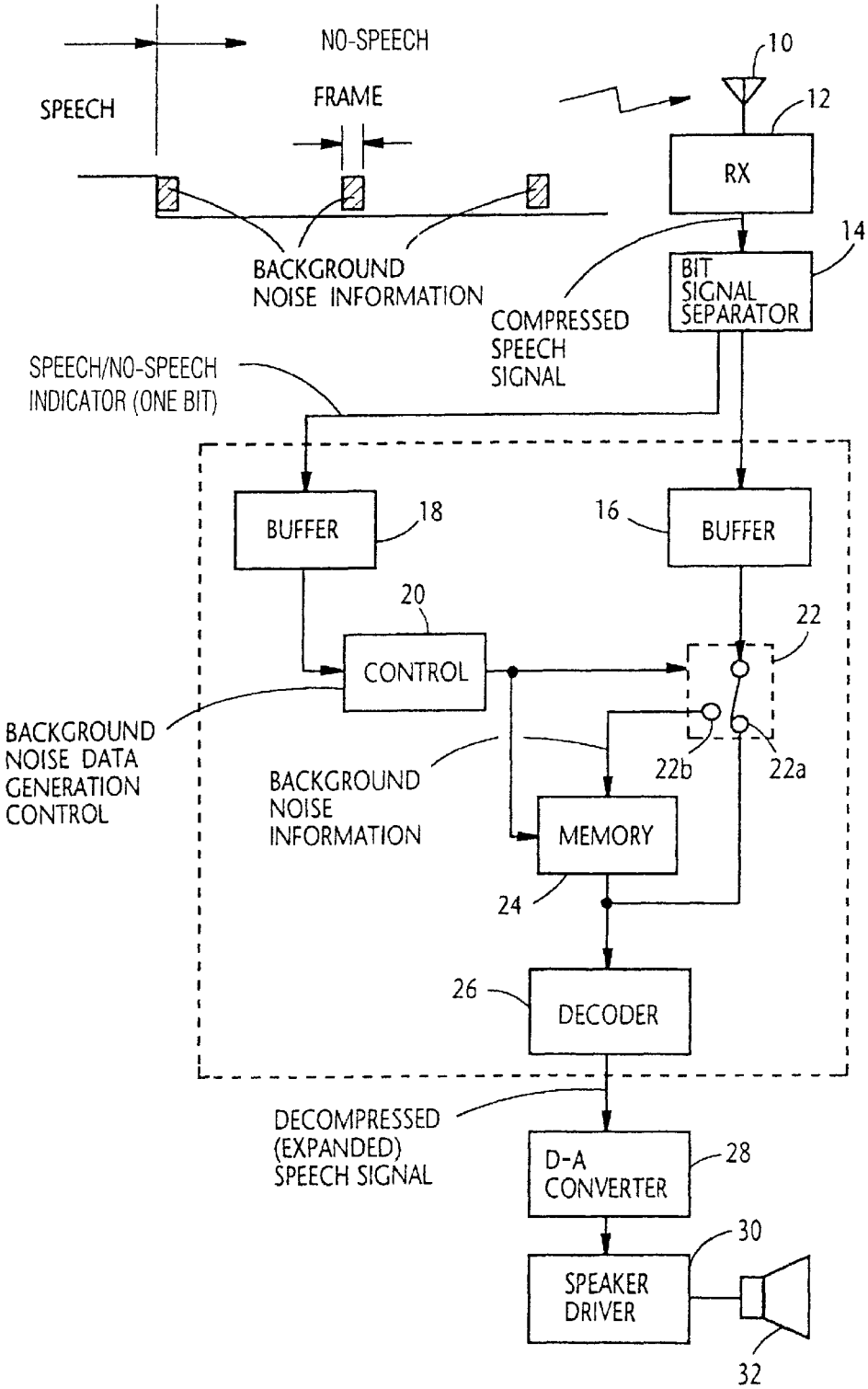
FIG. 1 (PRIOR ART)
FIG. 1 is a diagram schematically showing a conventional arrangement for generating background noise samples in a mobile telephone unit, together with associated portion thereof, this drawing having been referred to in the opening paragraphs.
Figure 2:
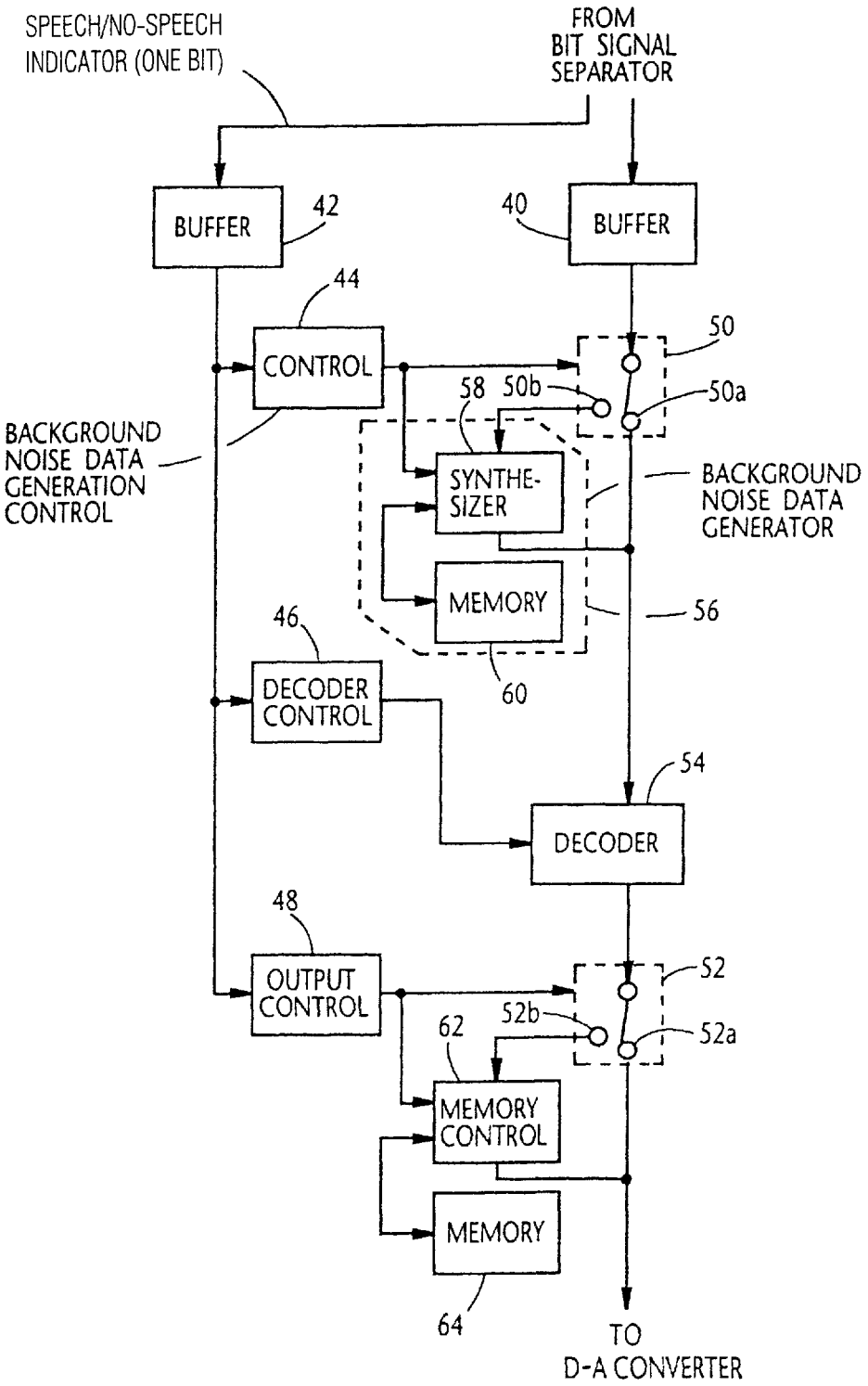
FIG. 2 is a diagram showing an arrangement for generating a background noise samples, which feature intermittent de-energizing of a decoder, according to the present invention.

FIG. 2 is a block diagram schematically showing an arrangement relevant to the present invention. Two buffers 40 and 42 are provided which respectively correspond to the counterparts 16 and 18. A circuit arrangement preceding the buffers 40 and 42 is exactly the same as that referred to in connection with FIG. 1.

To iterate the above description, the compressed baseband signal, which is outputted from the receiving section 12 (Fig 1), takes the form of a series of frames each including 100 bits (for example). One bit of each frame is dedicated to an indicator, which specifies whether the frame is a speech signal or a no-speech signal. The voiced/no-speech indicator bit is typically a leading bit of each frame. The output of the receiving section 12 (FIG. 1) is applied, on a frame-by frame basis, to the bit signal separator 14 (FIG. 1) which separates the one-bit of speech/no-speech indicator and the remaining bits (viz., 99 bits according to the above-mentioned assumption).

The data bits are applied to the buffer 40, while the speech/no-speech indicator bit is applied to the buffer 42. Assuming that the speech/no-speech indicator bit assumes a logic "1" for indicating that the corresponding frame is a speech frame while assuming a logic "0" for indicating that the corresponding frame is a no-speech frame.

The output of the buffer 42 is supplied to a background noise generation controller 44, a decoder controller 46, and an output controller 48. Considering the case where the output of the buffer 42 takes a logic "I" which means that the corresponding frame is a speech signal frame. In this case, the controllers 44 and 48 respectively control switches 50 and 52 in a manner that the data output of the 2C buffer 40 flows to the D-A controller 28 (FIG. 1) through a decoder 54. Thus, the speech signal is decompressed at the decoder 54, after which original voice is reproduced at the speaker 32 (FIG. 1) using the D-A converter 28 and the speaker driver 30 (both FIG. 1) as mentioned in the opening paragraphs.

On the other hand, when the output of the buffer 42 takes a logic "0", the controller 44 controls the switch 50 so as to relay, via a switch terminal 50*b*, one frame of background noise signal to a synthesizer 58 forming part of a background noise generator 56. The synthesizer 58 synthesizes a background noise data using one frame background noise data which has been stored in a memory 60. More specifically, the data stored in the memory 60 is the preceding one frame background noise data.

The operation of the background noise generator 56 will be described in detail with reference to FIGS. 3 and 4.

Figure 3:
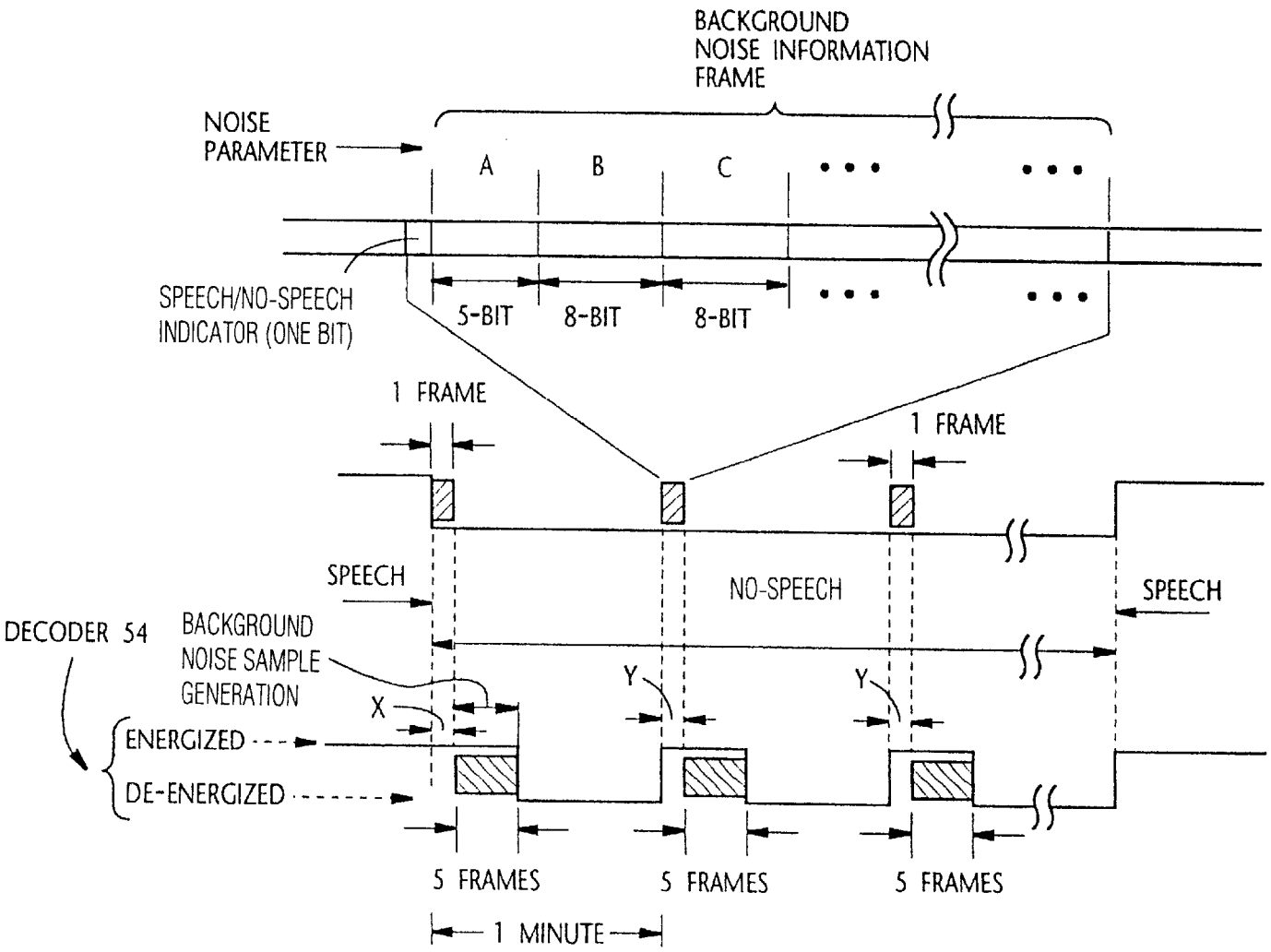
FIG. 3 is a diagram showing the operation of generating background data in connection with the arrangement of FIG. 2.

As shown in FIG. 3, during periods of no-speech, a plurality of pieces of background noise information are successively applied to the buffer 40 (FIG. 2). It is to be noted that the no-speech data is the coded background noise information. Each frame of background noise information comprises a plurality of noise parameters denoted A, B, C, etc. Each noise parameter represents an instantaneous phenomenon reflecting a speakers voice, environment noise, etc. which are picked up and generated at the transmitter. By way of example, the noise parameter A represents an instantaneous amplitude of the voice of a speaker person, while the noise parameter B represents the envelope characteristics of the speaker's voice. On the other hand, the noise parameter C represents a pitch of vibration period of the speaker's Vocal cords. For a better understanding of the disclosure, it is assumed that the bit lengths of the parameters A, B, and C are respectively 5 bits, 8 bits, and 8 bits. In addition, an excitation signal may be used as a background noise parameter.

As shown in FIG. 3, after one frame of the background noise information is received at the noise data generator 56

(FIG. 2), the background noise data are generated over a predetermined time length (corresponding to 5 frames for example). The background noise data of 5 frames are successively decoded at the decoder 54, and are applied to the D-A converter via a memory controller 62. At the same time, these 5 frames of decoded background noise samples are successively stored in a memory 64. After the generation of the decoded background noise samples over 5 frames is completed, the decoded noise samples stored in the memory 64 are successively retrieved on a frame basis (viz., the first frame to the 5-th frame), and are successively applied to the D-A converter 28 (FIG. 1). The decoded noise sample retrieval as just mentioned is repeated until the next background noise information is applied to the arrangement of FIG. 2, the manner of which is schematically illustrated in FIG. 3.

As shown in FIG. 3, the decoder 54 is energized during a frame X which is the first frame of the period of no-speech. This is because the receiver is unable to previously know when the no-speech starts. Further, as shown in FIG. 3, the decoder 54 is energized during a frame Y. However, after the receiver enters into the no-speech mode, it is able to previously know when the frame Y comes. Therefore, it is possible to design the receiver so as to de-energize the decoder 54 until the next frame Y.

Figure 4:
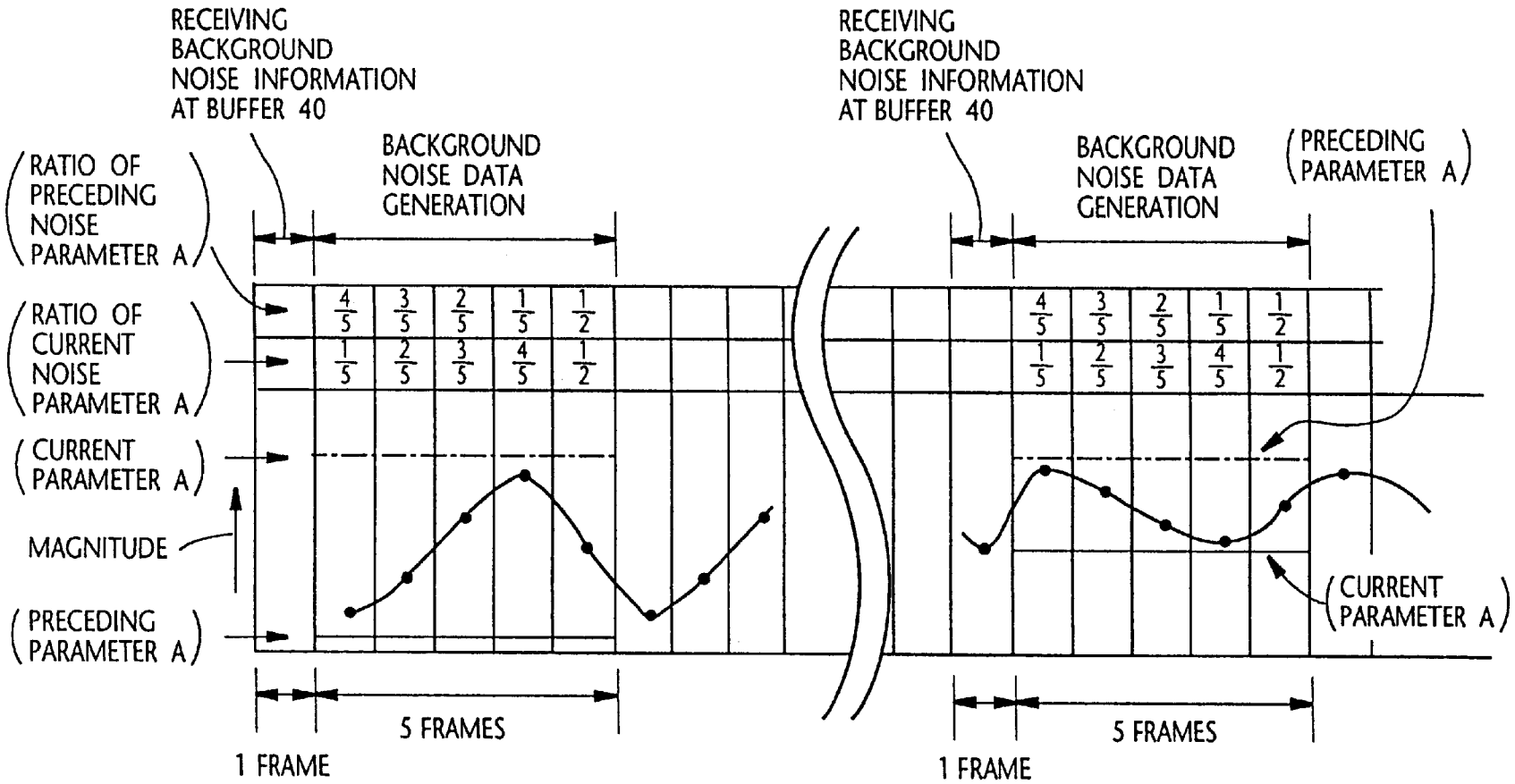
FIG. 4 is a diagram showing the operation of generating background data using interpolation techniques.

Referring to FIG. 4, there is schematically shown one example of generating (synthesizing) the background noise data using a linear interpolation technique. Although the example shown in FIG. 4 is concerned with the noise parameter A (FIG. 3), the same discussion is applicable to other noise parameters such as B and C of FIG. 3.

The synthesizer 58 receives the parameter A included in the background noise information (this parameter A is denoted by "current parameter A") using the noise parameter A stored in the memory 60 (this parameter A is denoted by previous parameter A). More specifically, as shown in FIG. 4, the ratios (proportions) of the preceding noise parameter A over 5 frames are 4/5, 3/5, 2/5, 1/5 and 1/2, while the ratios (proportions) of the current noise parameter A over 5 frames are 1/5, 2/5, 3/5, 4/5 and 1/2. As mentioned above, the noise data thus generated are stored in the memory 60, and are successively retrieved therefrom in a repeated manner. It is important to prevent discontinuous sound (viz., discomfort feeling) from being applied to a subscriber. To this end, each of the ratios of the current and preceding noise parameters A is set to 1/2 at the fifth frame of the background noise data generation. As mentioned above, each of other noise parameters B and C is interpolated in the same manner. Generally, it is empirically sufficient in terms of audibility if the noise parameters A and B are interpolated. However, it is within the scope of the present invention to use only one noise parameter in the case of which it is sufficient for the background noise information contains one noise parameter. As mentioned, the noise parameter A represents an instantaneous amplitude of the voice of a speaker person, while the noise parameter B represents the envelope characteristics of the speakers voice.

As an alternative, the background noise data can be synthesized by processing the noise parameter C (for example) using random numbers. The parameter C has been referred to as a pitch of vibration period of the speaker's vocal cords. In this case, a previously received noise parameter is not used and therefore, the memory 60 is dispensable.

Figure 5:
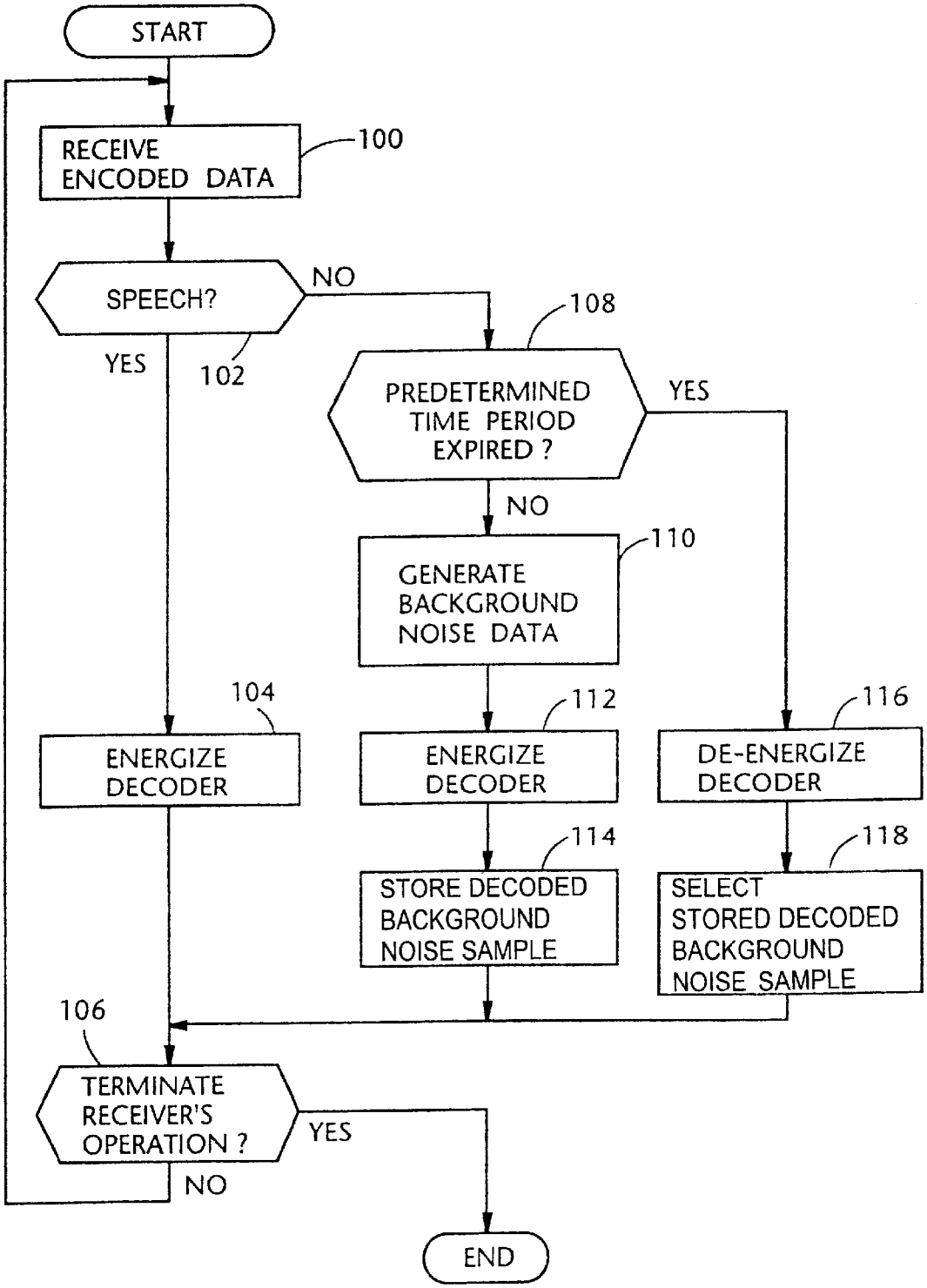
FIG. 5 is a flow chart which shows the steps which characterize the operation of the present invention as applied to the arrangement of FIG. 2.

FIG. 5 is a flow chart, which shows the steps which characterize the operation of the present invention as applied to the arrangement of FIG. 2. In the foregoing, the operation has been discussed in detail and, as such, the flow chart of FIG. 5 is briefly discussed for brevity.

The flow chart of FIG. 5 will be described together with FIG. 2. At step 100, 10 the incoming encoded data is received at the buffers 40 and 42 on a frame-by-frame basis. At step 102, a check is made to determine if the frame received is the speech frame. If the answer to an inquiry made at step 102 is affirmative, the routine goes to step 104 at which the decoder 54 is energized for decoding the speech signal. At step 106, a further check is made to determine if the receiver terminates the operation thereof. If the answer is negative at step 106, the program goes back to step 100. Otherwise, the program is terminated.

If the answer to an inquiry made at step 102 is negative (viz., NO), the program proceeds to step 108 at which a check is further made to determine if a predetermined time period (viz., 5 frames in the aforesaid embodiment) has expired. If the answer at step 108 is negative (NO), the background noise data are synthesized at the background noise data generator 56 at step 110. Thereafter, the decoder 54 is energized at step 112. Further, the background noise samples decompressed at the decoder 54 are successively stored in the memory 64 (step 114), and at the same time, the decoded noise samples are fed to the following circuit (viz., the D-A 21, converter). Following this, the program goes to step 106.

On the other hand, if the answer at step 108 is positive (viz., YES), the routine goes to step 116 at which the decoder 54 is de-energized for the purpose of power conservation. Thereafter, at step 118, the decoded noise samples stored in the memory 64 are read out thereof on a frame-by-frame basis and this noise samples reading is repeated until the next set of decoded noise samples (5 frames) are stored in the memory 64.

It will be understood that the above disclosure is representative of only a preferred embodiment of the present invention and that the concept on which the invention is based is not specifically limited thereto.

What is claimed is:

1. A method of generating background noise samples in a radio receiver, comprises the steps of:

checking to determine if incoming data is noise information;

generating background noise data, using at least one noise parameter included in said incoming noise information, if said incoming data is specified as the noise information;

energizing a decoder for decoding the background noise data so as to generate decoded background noise samples; and storing the decoded background noise samples into a memory, whereupon the decoder is turned off until the next noise information is received.

2. A method as claimed in claim 1, further comprising the step of retrieving said decoded background noise samples from said memory during the period of no-speech.

3. An apparatus for generating background noise samples, in a radio receiver, in radio receiver, using at least one noise parameters included in noise information which is transmitted at predetermined time intervals during a period of no-speech, said apparatus comprises:

a controller for controlling generation of background noise data, said controller checking to determine if incoming data is noise information;

a background noise generator for generating background noise data using said at least noise parameter if said incoming data is specified as the noise information;

a decoder for decoding said background noise data so as to generate the decoded background noise samples; and a memory for storing the decoded background noise samples, whereupon the decoder is turned off until the next noise information is received by the apparatus.

4. A method of generating background noise samples in a radio receiver, comprising the steps of:

(a) checking to determine if an incoming framed data is noise information;

(b) checking to determine if a time period corresponding to a predetermined number of frames has expired if said incoming framed data is specified as the noise information;

(c) generating background noise data, using at least one noise parameter included in said noise information, extending to said predetermined number of frames if said time period has not expired at step (b);

(d) energizing a decode for successively decoding the background noise data so as to generate decoded background noise samples;

(e) storing said decoded background noise samples generated at step (d) into a memory in order to be retrieved during the period of no-speech while de-energizing the decoder.

(f) de-energizing said decoder if said time period has expired at step (b); and (g) retrieving successively said decoded background noise samples, stored in said memory, on a frame-by-frame basis.

5. A method as claimed in claim 4, wherein said background noise samples, which are stored in said memory, are cyclically retrieved from said memory on a frame-by-frame, during the period of no-speech, until next decoded background noise samples are stored in said memory.

6. A method as claimed in claim 4, wherein said decoded background noise samples are generated using interpolation.

7. A method as claimed in claim 6, wherein the interpolation is implemented using a current noise parameter and a previously received noise parameter, said previously received noise parameter having been stored in another memory.

8. A method as claimed in claim 4, wherein said at least one noise parameter represents an amplitude of the voice of a speaker at a transmitter.

9. A method as claimed in claim 4, wherein said at least one noise parameter represents an envelope characteristics of speaker's voice at a transmitter.

10. A method of generating background noise samples in a radio receiver, comprising the steps of:

(a) checking to determine if an incoming framed data is noise information;

(b) checking to determine if a time period corresponding to a predetermined number of frames has expired if said incoming framed data is specified as the noise information;

(c) generating the background noise data, using at least one noise parameter included in said noise information, extending to said predetermined number of frames if said time period has not expired at step (b);

(d) energizing a decoder for successively decoding the background noise data so as to generate background noise samples;

(e) storing the decoded background noise samples generated at step (d) into a memory;

(f) de-energizing said decoder if said time period has expired at step (b); and (g) retrieving successively said decoded background noise samples, stored in said memory, on a frame-by-frame basis.

11. An apparatus for generating coded background noise samples, at a radio receiver, using at least one noise parameter, said at least one noise parameter included in framed noise information which is transmitted at predetermined time intervals during a period of no-speech, said apparatus comprising:

a controller for controlling generation of background noise data, said controller checking to determine if an incoming framed data is noise information;

a background noise data generator which, in response to a check result of the incoming framed data being the noise information, generates the background noise data using said at least one noise parameter, said background noise data extending to a predetermined number of frames;

a decoder for decoding said background noise data generated by said background noise data generator so as to generate background noise samples; and a memory for storing the decoded background noise samples generated by said decoder in order to be retrieved during the period of no-speech while de-energizing the decoder.

12. An apparatus as claimed in claim 11, wherein said background noise data generator comprises a synthesizer and another memory, said synthesizer implementing interpolation using a current noise parameter and a previously received noise parameter, said previously received noise parameter having been stored in said another memory.

13. An apparatus as claimed in claim 11, wherein said at least one noise parameter represents an amplitude of the voice of a speaker at a transmitter.

14. An apparatus as claimed in claim 9, wherein said at least one noise parameter represents an envelope characteristics of speaker's voice at a transmitter.

* * * * *